US011828573B2

(12) United States Patent
Gallimore et al.

(10) Patent No.: US 11,828,573 B2
(45) Date of Patent: Nov. 28, 2023

(54) INTELLIGENT MUNITION

(71) Applicant: Harkind Dynamics, LLC, Denver, CO (US)

(72) Inventors: Craig Allen Gallimore, Denver, CO (US); Kelley Stewart Weiland, Fredericksburg, VA (US)

(73) Assignee: Harkind Dynamics, LLC, Denver, CO (US)

( * ) Notice: Subject to any disclaimer, the term of this patent is extended or adjusted under 35 U.S.C. 154(b) by 0 days.

(21) Appl. No.: 17/667,171

(22) Filed: Feb. 8, 2022

(65) Prior Publication Data

US 2022/0163295 A1 May 26, 2022

Related U.S. Application Data

(63) Continuation of application No. 17/009,183, filed on Sep. 1, 2020, now Pat. No. 11,280,591.

(60) Provisional application No. 62/895,354, filed on Sep. 3, 2019.

(51) Int. Cl.

| | |
|---|---|
| ***F41H 13/00*** | (2006.01) |
| ***F42B 10/56*** | (2006.01) |
| ***F42B 7/02*** | (2006.01) |

(52) U.S. Cl.

CPC ..... *F41H 13/0031* (2013.01); *F42B 7/02* (2013.01); *F42B 10/56* (2013.01)

(58) Field of Classification Search

CPC ..... F41H 13/0031; F42B 7/02; F42B 10/56

USPC ..... 102/438, 444, 458, 502, 505, 512, 513, 102/520, 521–523, 529, 387, 340, 337, 102/354, 339, 348, 357, 342

See application file for complete search history.

(56) References Cited

U.S. PATENT DOCUMENTS

| | | | | | |
|---|---|---|---|---|---|
| 3,962,537 | A | | 6/1976 | Kearns et al. | |
| 5,473,501 | A | * | 12/1995 | Claypool | H05C 1/04 361/232 |
| 5,698,815 | A | * | 12/1997 | Ragner | F41H 13/0006 102/504 |
| 5,831,199 | A | * | 11/1998 | McNulty, Jr. | F41H 13/0025 361/232 |
| 5,898,125 | A | * | 4/1999 | Mangolds | F41H 13/0031 102/504 |
| 5,962,806 | A | * | 10/1999 | Coakley | F41H 13/0031 102/293 |
| 6,877,434 | B1 | * | 4/2005 | McNulty, Jr. | F42B 12/36 102/502 |
| 6,880,466 | B2 | * | 4/2005 | Carman | F41H 13/0031 119/908 |

(Continued)

FOREIGN PATENT DOCUMENTS

| | | | | |
|---|---|---|---|---|
| GB | 2384042 B | | 11/2002 | |
| GB | 2384042 A | * | 7/2003 | F41H 13/0031 |

*Primary Examiner* — John Cooper

(74) *Attorney, Agent, or Firm* — Hall Estill Law Firm; Randall K. McCarthy

(57) ABSTRACT

A small arms form factor munition may package a control section with a deployment section in a munition case. The control section can have a first drag mechanism and a second drag mechanism. Firing the munition case from a firearm propels the load from the munition case and barrel of the firearm towards a target. A drag mechanism is selected and activated by the control section in response to a detected distance to the target while the load is in flight. The drag mechanism alters a flight characteristic of the load.

20 Claims, 7 Drawing Sheets

(56) References Cited

U.S. PATENT DOCUMENTS 7,042,696 B2 * 5/2006 Smith ..... F42B 12/36 361/232
7,490,769 B2 2/2009 Hall
7,856,929 B2 * 12/2010 Gavin ..... F41H 13/0025 361/232
7,886,648 B2 2/2011 Williams et al.
7,984,676 B1 * 7/2011 Gavin ..... F42B 5/073 361/232
7,984,679 B1 7/2011 McFee
8,281,697 B2 10/2012 McGants, Jr.
8,375,838 B2 2/2013 Rudakevych et al.
8,837,107 B2 9/2014 Hinz et al.
8,953,297 B2 2/2015 Gavin
9,173,378 B2 11/2015 Beechey et al.
9,234,728 B2 1/2016 Akcasu et al.
9,528,802 B1 12/2016 Markowitch et al.
9,618,303 B2 * 4/2017 Hensler ..... F41H 13/0031
9,816,789 B1 * 11/2017 Hyde ..... F41H 13/0025
10,081,057 B2 9/2018 Burrow
10,288,398 B1 * 5/2019 Verini ..... F42B 5/145
2005/0039628 A1 * 2/2005 Carman ..... H05C 1/00 119/908
2005/0073796 A1 * 4/2005 Smith ..... F42B 12/36 361/232
2005/0188887 A1 * 9/2005 Chang ..... F41C 9/00 102/502
2006/0162605 A1 * 7/2006 Genis ..... F41H 13/0031 102/512
2006/0254108 A1 * 11/2006 Park ..... H05C 1/06 361/232
2006/0279898 A1 * 12/2006 Smith ..... F41H 13/0025 361/232
2007/0019357 A1 * 1/2007 Keely ..... F41H 13/0031 361/232
2007/0101893 A1 * 5/2007 Shalev ..... F42B 12/36 102/512
2007/0283834 A1 * 12/2007 Chen ..... F41H 13/0025 102/502
2009/0020002 A1 * 1/2009 Williams ..... F41H 13/0031 89/41.03
2010/0101445 A1 * 4/2010 Garg ..... F42B 12/36 102/502

* cited by examiner

INTELLIGENT MUNITION

RELATED APPLICATION

The present application is a continuation of U.S. application Ser. No. 17/009,183, filed Sep. 1, 2020, which claims priority to U.S. Provisional Patent Application No. 62/895,354 filed Sep. 3, 2019, the contents of which are hereby incorporated by reference.

GOVERNMENT SUPPORT

This invention was made with government support under M67854-19-P-6612 awarded by MARCORSYSCOM. The government has certain rights in the invention.

SUMMARY

Various embodiments of an intelligent munition positions a control section proximal a deployment section with the deployment section consisting of at least one electrode projectile tethered to a power source. The control section is attached to the deployment section to form a load that is packaged into a munition case. The munition case is fired from a firearm to propel the load from the munition case and a barrel of the firearm towards a target. At least one drag mechanism is activated by the control section while the load is in flight to alter a flight characteristic of the load to ensure non-lethality of the load.

An intelligent munition, in accordance with some embodiments, has a small arms form factor munition that packages a control section with a deployment section in a munition case. The control section has a first drag mechanism and a second drag mechanism. Firing the munition case from a firearm propels the load from the munition case and barrel of the firearm towards a target. A drag mechanism is selected and activated by the control section in response to a detected distance to the target while the load is in flight. The drag mechanism alters a flight characteristic of the load.

DETAILED DESCRIPTION

Historically, munitions have been rather crude with a projectile being shot through the air via an explosive charge. Modern electronics technology has allowed for the incorporation of circuitry into some munitions, like rockets and missiles, but those devices were rather large, complex, and expensive. As electronics and computing capabilities have evolved, intelligent electronics have become small enough to incorporate into small-scale munitions, such as shotgun shell form factors.

While munitions utilizing modern technology have greater damage wielding capabilities, there is an increasing trend for non-lethal munitions that disable a target instead of wounding or killing the target. Conventional non-lethal munitions configured to disable a target are plagued with inaccuracy, short range, and inconsistent results. Hence, there is a need for a non-lethal munition that can accurately disable a target from a relatively long range utilizing intelligence provided by on-board circuitry.

With these issues in mind, embodiments of a munition provide non-lethal deployment of one or more electrodes after intelligently controlling the position and flight of a load in response to a detected, or measured, position of the load relative to a target. A munition can have modularity that allows a user to interchange portions of a load to provide different capabilities, performance, and compatibilities. The utilization of multiple different parasitic drag mechanisms can provide diverse flight control for a load to orient electrodes for optimal, non-lethal deployment. The ability to incorporate intelligence and electronic circuitry into the munition allows for sophisticated electrode usage, efficient usage of on-board power, and monitoring of target condition to effectively subdue a target and maintain the target in a disabled condition for a relatively long duration.

Figure 1:
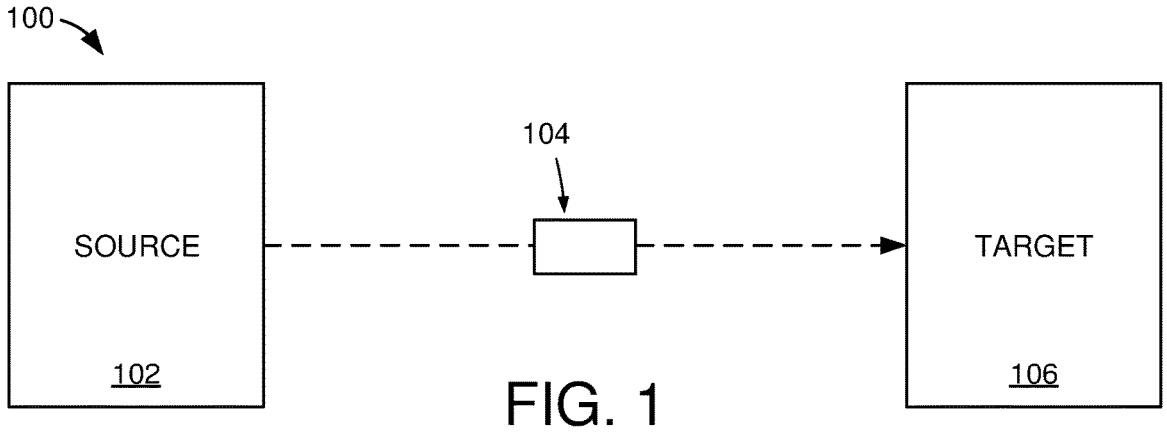
FIG. 1 displays a block representation of an example shooting environment in which various embodiments may be practiced.

FIG. 1 depicts a block representation of an example shooting environment 100 in which various embodiments of an intelligent munition can be practiced. A munition source 102 can be configured to shoot one or more projectiles 104 towards at least one target 106. It is contemplated that the munition source 102 is a firearm that destroys a portion of a munition to propel the projectile 104 portion of the munition towards the target 106. With the projectile 104 traveling at the target 106 at a high rate of speed, such as 500+ feet per second, the lethality of the projectile is high. While non-lethal projectiles are possible, such as a bag or rubber bullets, the accuracy of those projectiles are not good, particularly over relatively long ranges (X), such as greater than 150 feet to 45 m depending on the munition size.

Figure 2:
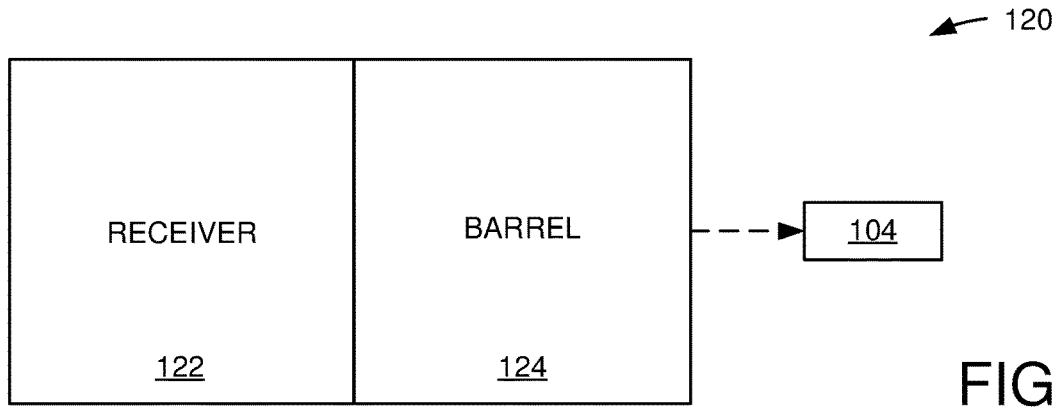
FIG. 2 depicts portions of an example firearm that may be employed in the shooting environment of FIG. 1.

FIG. 2 depicts a block representation of an example firearm 120 that can be employed as a munition source 102 in the shooting environment 100. The firearm 120 can be any type, size, and caliber, such as a 9 mm-40 mm handgun or rifle that is automatic, semi-automatic, or manual, that employs any manner of trigger and munition activation mechanism. In some embodiments, the firearm 120 is a shotgun that has a munition receiver 122 coupled to a barrel 124. A munition, such as a shotgun shell having a 12-gauge form factor, is loaded into the receiver 122 manually, or automatically, and engaged with a firing mechanism, such as at least a firing pin, to ignite a portion of the munition and propel a projectile 104 load portion of the munition down the barrel 124.

It is contemplated that the barrel 124 is smooth or has riflings that spin the projectile as it travels through the barrel 124. Upon breach of the projectile 104 load from the muzzle of the barrel 124, a muzzle velocity can be measured that corresponds with the possible range of the projectile. Although not required or limiting, embodiments arrange a munition with propellant that produces approximately 140 m/s muzzle velocity for the projectile 104 load, which allows for an accurate projectile 104 range of 100 meters. Propelling the projectile 104 can allow for additional projectiles 104 to be quickly loaded and shot from the firearm 120, but such increased cyclic capability does not increase the ability for the projectile(s) to provide a non-lethal and temporarily disabling condition for a target.

Figure 3:
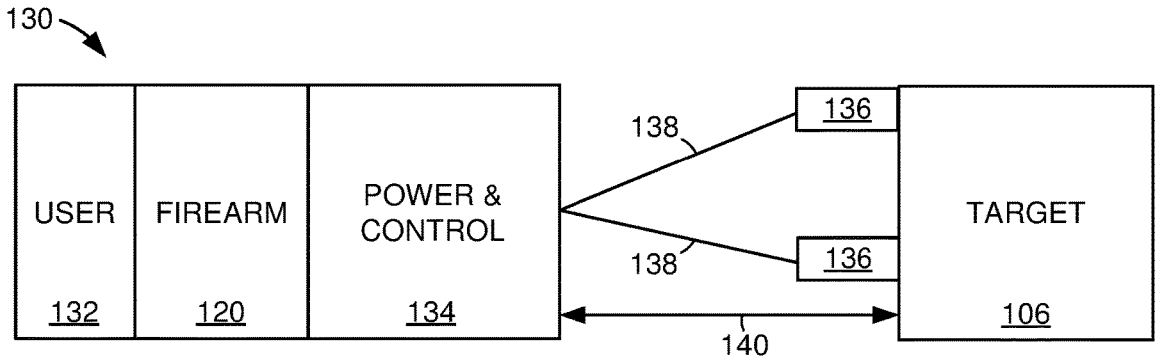
FIG. 3 depicts portions of an example electrode-based weapon that may be utilized in some embodiments of an intelligent munition.

FIG. 3 depicts a block representation of an example non-lethal electrode-based weapon 130 that can be used in the shooting environment 100 of FIG. 1. A user 132 engages at least a housing 134 where electrode power and control are supplied. Upon activation by the user 132, the housing 134 can deploy one or more electrodes 136 towards at least one target 106. It is contemplated that the housing 134 has a power source coupled to automatic, and/or manual, controls for electrifying the electrodes 136 via conductive tethers 138 and disabling the target 106.

The use of electrical discharge instead of a projectile striking and/or penetrating the target 106 allows for more reliable non-lethal force to be applied. However, the capabilities of the electrodes 136 are limited by the length of the respective tethers 138, which restricts the effective range 140 of the electrode-based weapon 130, such as to less than 10 m. Thus, there is a need for a weapon that can provide the reliable non-lethality of the electrodes 136 with the range and cyclic capability of a projectile-based firearm 120.

Figure 4A:
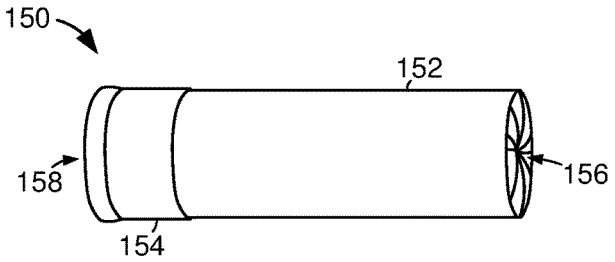
FIGS. 4A-4C respectively depict assorted aspects of an example intelligent munition configured in accordance with various embodiments.
Figure 4B:
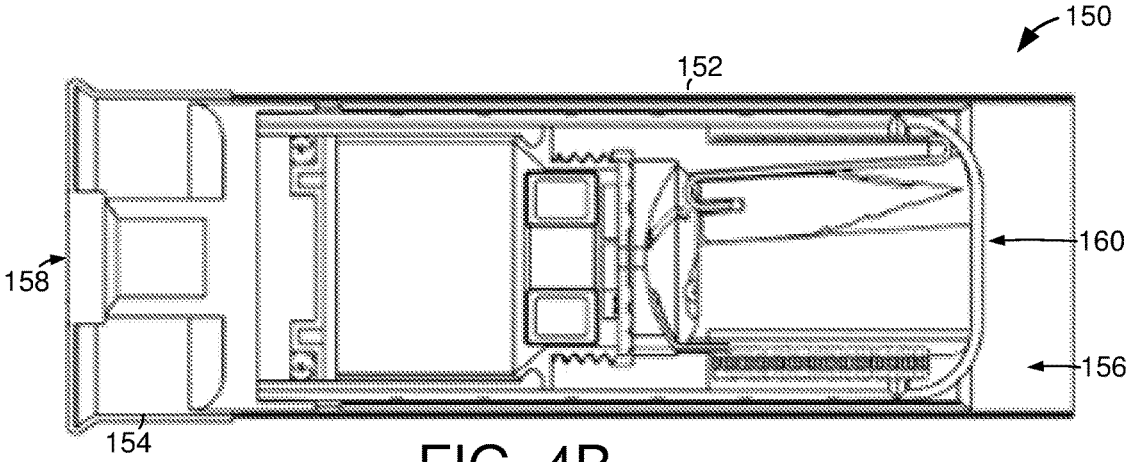
Figure 4C:
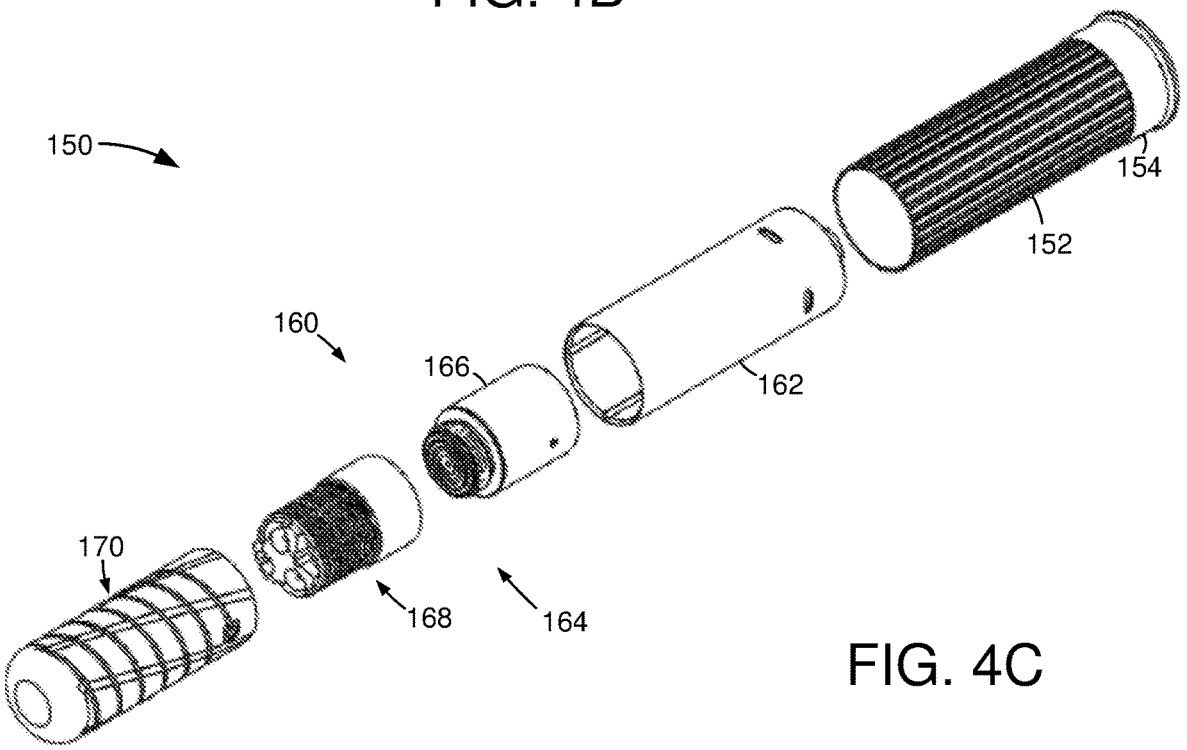

FIGS. 4A-4C depict assorted views of an example munition 150 that can be loaded and shot from a firearm 120 while providing electrode capabilities of the weapon 130 of FIG. 3. FIG. 4A displays an example munition 150 prior to being loaded or shot from a firearm 120. The munition 150 has a case 152 that can be made of any material, such as plastic, metal, ceramic, paper, or polymer, and configured with a size that surrounds and protects an internal load. Some embodiments of the munition 150 construct the munition 150 with a 12-gauge form factor, but other sizes may be employed, such as 20 gauge or 9 mm-40 mm diameter.

It is noted that the form factor, and/or length, of the case 152 can correspond with the amount of gunpowder, or other propellant, that can be packaged within the munition cavity 156. As such, different munition case 152 sizes can be utilized to provide different munition ranges, muzzle velocities, and packaged munition weight. The internal propellant can be activated with one or more primers 158 that are positioned within a head 154 portion of the munition 150. Due to the explosive activation of the propellant via the primer 158, the head 154 may be a different, more robust, material than the case 152, such as a metal, ceramic, or rubber, that reliably positions the primer 158 for contact with a firing pin of the firearm while ensuring the resulting propellant explosion forces the internal munition load down the firearm barrel instead of backward towards the firing mechanism of the receiver.

The cross-sectional view of FIG. 4B illustrates how the munition 150 can be packaged prior to being shot. A non-lethal load 160 is positioned within the internal cavity 156 of the case 152 and configured to be ejected from the case 152 upon activation of the propellant positioned between the load 160 and the primer 158. As shown in the exploded view of FIG. 4C, the load 160 can consist of a sabot 162 that surrounds and secures an electrode assembly 164 before, and during, being shot from the case 152. It is contemplated that the sabot 162 allows the load 160 to spin and fly through the firearm barrel like a projectile to gain muzzle velocity and improve down range accuracy when fired through smooth-bore firearms that have no riflings. However, the load 160 may also have deployable aerodynamic control surfaces to induce spin, or drag, to stabilize the load after leaving the firearm barrel.

In some embodiments, the electrode assembly 164 has a control section 166 connected to an electrode deployment section 168 and an antenna ballistic shell 170. The control section 166 can provide electrical power and intelligent hardware control of the deployment and activation of electrodes housed in the deployment section 168. The antenna ballistic shell 170 can be configured with one or more antennas that can communicate with a user 132, firearm 120, or control module that remains proximal the firearm during load 160 travel down range. The antenna ballistic shell 170, in some embodiments, positions one or more antennae in the nose of the munition, as opposed to a position wrapped around the munition. It is explicitly noted that there is no physical connection between the load 160 and the firearm 120 or user 132 once the load 160 leaves the firearm barrel 124, which contrasts the electrode wires 138 that limit effective deployment range of tasers and other tethered, hand-held devices.

The construction, position, and function of an antenna can be optimized to allow the control section 166 to automatically and simultaneously identify where the load 160 is relative to the firearm/user and the target. For instance, one or more types of antennas can concurrently, or sequentially, be active to wirelessly communicate data with a user and/or stationary control module that identifies how far down range the load 160 is in real-time. An antenna can be supplemented, or replaced, by an internal timer of the control section 166 that identifies the load's position relative to the firearm and/or target based on the load's muzzle velocity detected by one or more sensors contained with the control section 166.

The use of multiple antennas, in accordance with some embodiments, can provide a more secure and reliable load 160 deployment compared to using a single antenna, particularly in harsh environments where wireless communications, such as radio frequency, intermediate frequency, sonar, or optical wavelength, are degraded by magnetic, electrical, or mechanical noise. A secure and reliable wireless communication pathway allows the load 160 to be manipulated manually by a user. That is, an automatic load deployment scheme carried out by the control section 166 can be overridden or supplemented by user input. As a non-limiting example, a user can if identify the load 160 needs to move relative to a target, needs to deploy sooner, or needs to deploy later than prescribed by the scheme before initiating an alteration to the scheme to accommodate for such identified conditions.

It is noted that without the intelligent circuitry of the control section 166, the load 160 would not have the ability to communicate and would not be able to carry out an autonomous deployment scheme. Instead, a "dummy" load would be limited to the physical aspects and features arranged into the load, which would be quite unreliable and inefficient compared to the intelligent load 160 utilized in various embodiments.

In flight and after the load 160 exists a barrel muzzle, it is contemplated that the ballistic shell 170 protects the control 166 and deployment 168 sections while providing optimized flight characteristics, such as with grooves, veins, projections, or other physical features that increase the consistency of flight and accuracy of the load 160. It is contemplated that the ballistic shell 170 stays intact throughout flight or may break apart to reveal the electrode deployment section 168. Regardless of the configuration of the ballistic shell 170, the control section 166 and deployment section 168 become exposed at a detected distance from the firearm and/or target, such as 5 m, by ejecting the shell 170.

Figure 5A:
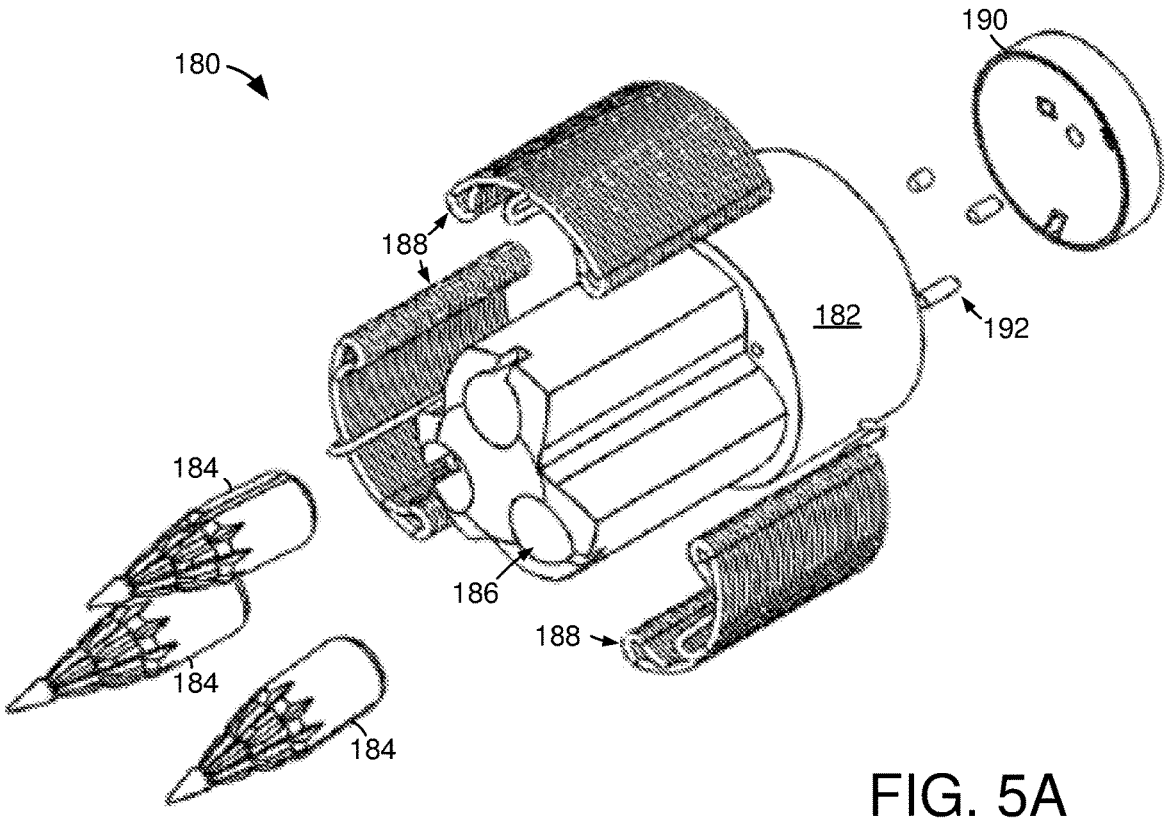
FIGS. 5A & 5B respectively depict portions of an example electrode deployment assembly arranged in accordance with assorted embodiments.
Figure 5B:
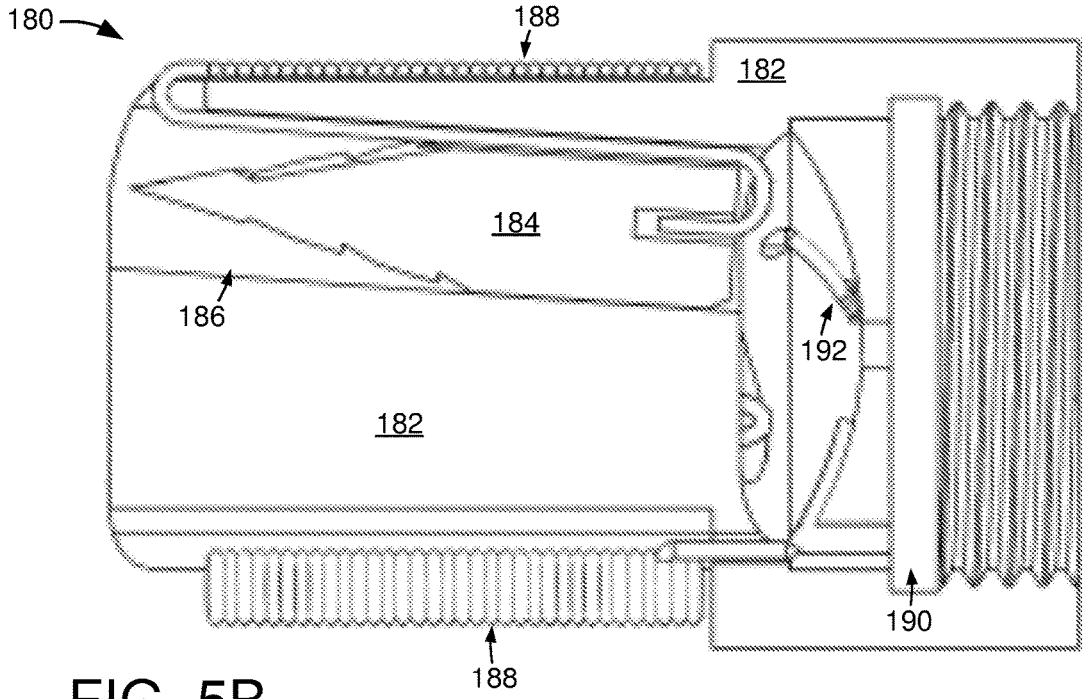

FIGS. 5A & 5B respectively depict portions of an example electrode deployment section 180 that can be employed in the munition 150 of FIGS. 4A-4C. The exploded view of FIG. 5A conveys how a base 182 can provide structural support for a plurality of separate electrodes 184 in various cavities 186 that can be oriented at parallel, or different, directions. Each electrode is connected to a separate electrically conductive tether 188 that are wound to promote efficient stretching once the electrodes 184 are propelled from their respective cavities 156 to electrically connect the load to a target to allow electrical shock to be intelligently administered. That is, the tethers 158 can be separated on the base 152 so that the tethers 158 do not tangle or interfere with each other once the electrodes 154 are deployed to attach to a target.

Although not required or limiting, each electrode 154 can be propelled by a propellant substance, such as gunpowder, pressurized air, or another explosive material, that is activated mechanically or electronically with a primer, igniter, or valve. In the event a powder propellant is used for the respective electrodes 184, the containment feature 190 can be configured to direct resultant force outward from the base 182. As shown, the containment feature 190 can have one or more apertures that allows electrical transfer rods 192 to pass electrical signals from a connected control section 168 to the electrodes 184 and tethers 188.

The cross-sectional view of FIG. 5B illustrates how the electrodes 184 can fit within the base cavities 186 and connect to the tethers 188. The electrodes 182 may have matching, or dissimilar, shapes and/or sizes to provide optimal transmission of electrical current into a target once the electrodes 184 physically attach to the target. The electrodes 182 may employ serrations, protrusions, and various sloped edges to promote efficient and accurate flight from the base 182 as well as physical connection to the target. It is contemplated that an electrode 184 can be configured to temporarily or permanently deform upon impact with a target to improve the chance of the electrode physically attaching to the target and maintaining a stable electrical connection with the target despite the target moving.

It is noted that the entire electrode deployment section 180 fits within a sabot 162 of a selected form factor, such as 12-gauge shotgun shell, 9 mm casing, or 40 mm casing, and connected to the control section 166 via a threaded joint 194 that can provide concurrent electrical and physical conductivity and support. The threaded joint 194 is not required, but assorted embodiments of an interchangeable connection, such as a keyed junction, magnet, adhesive, fastener, or combination thereof, allow the deployment section 180 to be installed, and removed, at will by a user. The interchangeable capability of sections of a munition allows a user to select capabilities and compatibilities. For instance, a deployment section 180 may be changed from three electrodes 184, as shown in FIG. 5A, to a single electrode 184 or from a first caliber to a different second caliber size.

Figure 6A:
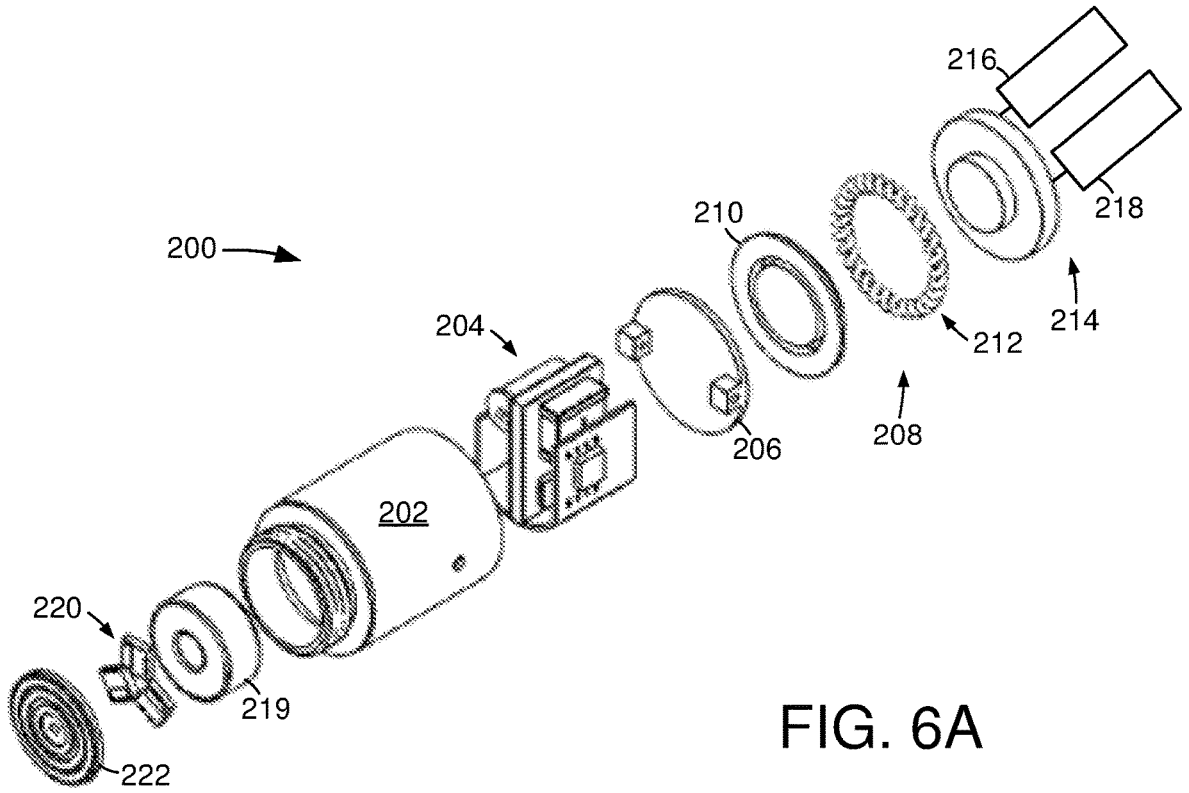
FIGS. 6A & 6B respectively depict portions of an example control assembly constructed and operated in accordance with some embodiments.
Figure 6B:
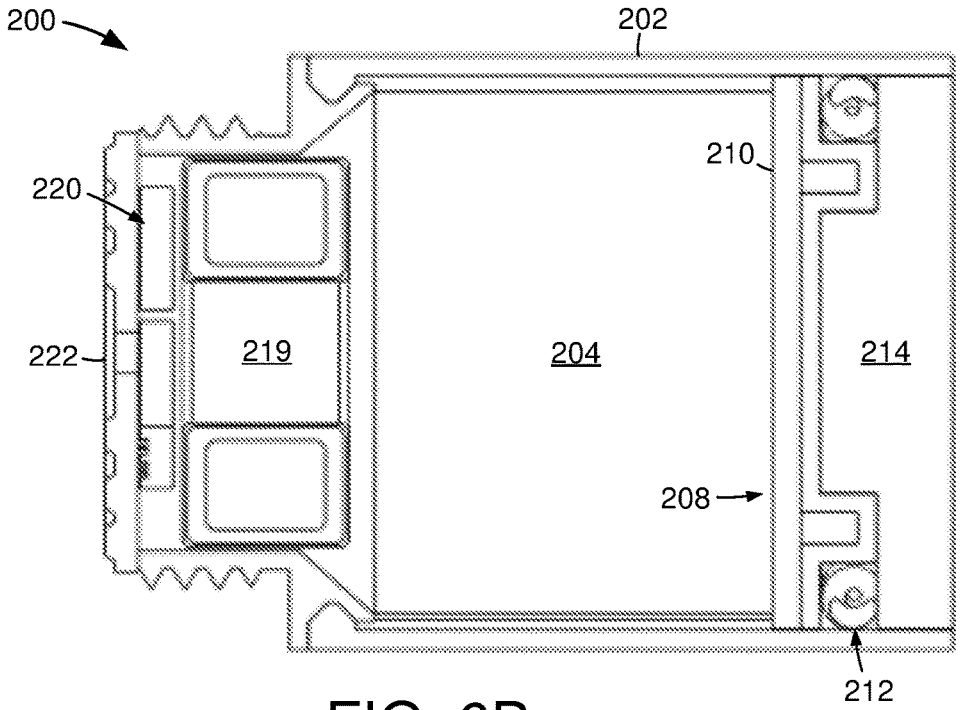

FIGS. 6A & 6B respectively depict aspects of an example control section 200 that can be incorporated into an intelligent munition in accordance with some embodiments. The exploded view of FIG. 6A conveys how the control section 200 can consist of multiple physical and electrical components that are configured to operate to provide optimal accuracy and non-lethal disabling of a target once shot from a firearm. The control section 200 employs a unitary housing 202 that physically supports and protects a control assembly 204 that comprises at least one power source, such as a battery, capacitor, or spring, which supplies electrical energy to local circuitry and to electrodes of an attached deployment section 180.

One or more electrical ground planes 206 can enable electrical operation of the control assembly 204 and optimize performance of sensors, which detect relative position of the target to the load. Upon electrical activation directed by the control assembly 204, one or more parasitic drag features 208 can be deployed from the control section 200 to slow the velocity of the munition to a predetermined value that promotes accurate, efficient, and non-lethal electrode deployment toward a target. Although not required or limiting, the parasitic drag feature 208 can have a contained propellant package 210 physically contacting a compressed garter spring 212 and a feature package 214.

A feature package 214 can contain one or more drag mechanisms 216/218, such as foils, streamers, flags, sails, parachutes, and loops, that can control the flight of a load containing the control section 200 while in flight. It is noted that the parasitic drag feature 208 configuration shown in FIG. 6A is not required or limiting and various embodiments concurrently employ separate and different parasitic drag features 208 in a single load. With multiple different parasitic drag features 208 present in a single load, the control section 200 can intelligently select when to deploy a feature 208 and which mechanism 216/218 to deploy.

The ejection of a drag mechanism 216/218 from the control section 200 can provide increased load stability, alter the load's speed, and/or change the range of the load while in flight. For instance, a drag mechanism 216 can be propelled from the control section 200 while remaining tethered to stabilize the load. As another non-limiting example, a drag mechanism 218 can be propelled from the control section in a detached manner to alter the speed and/or direction of the load. It is contemplated that a drag mechanism 218 is a burst of energy, such as compressed air or an explosion, that is propelled from behind the load to increase the load's speed and range or towards the front of the load to decrease the load's speed and range, which can ensure the load is delivered to a target with non-lethality.

The control housing 202 can additionally support an electrical transformer 219, such as a high voltage toroid transformer, that contacts a switching network 220 and an electrical transfer plate 222. The switching network 220 can consist of one or more circuits configured to provide pulsed electrical output to the electrodes connected via the transfer plate 222. The cross-sectional view of FIG. 6B illustrates how the assorted components of the control section 200 can be physically oriented within, and on, the housing 202. As shown, the electrical transfer plate 222 is positioned outside of the housing 202 while the other physical features are each contained wholly within the housing 202.

Figure 7:
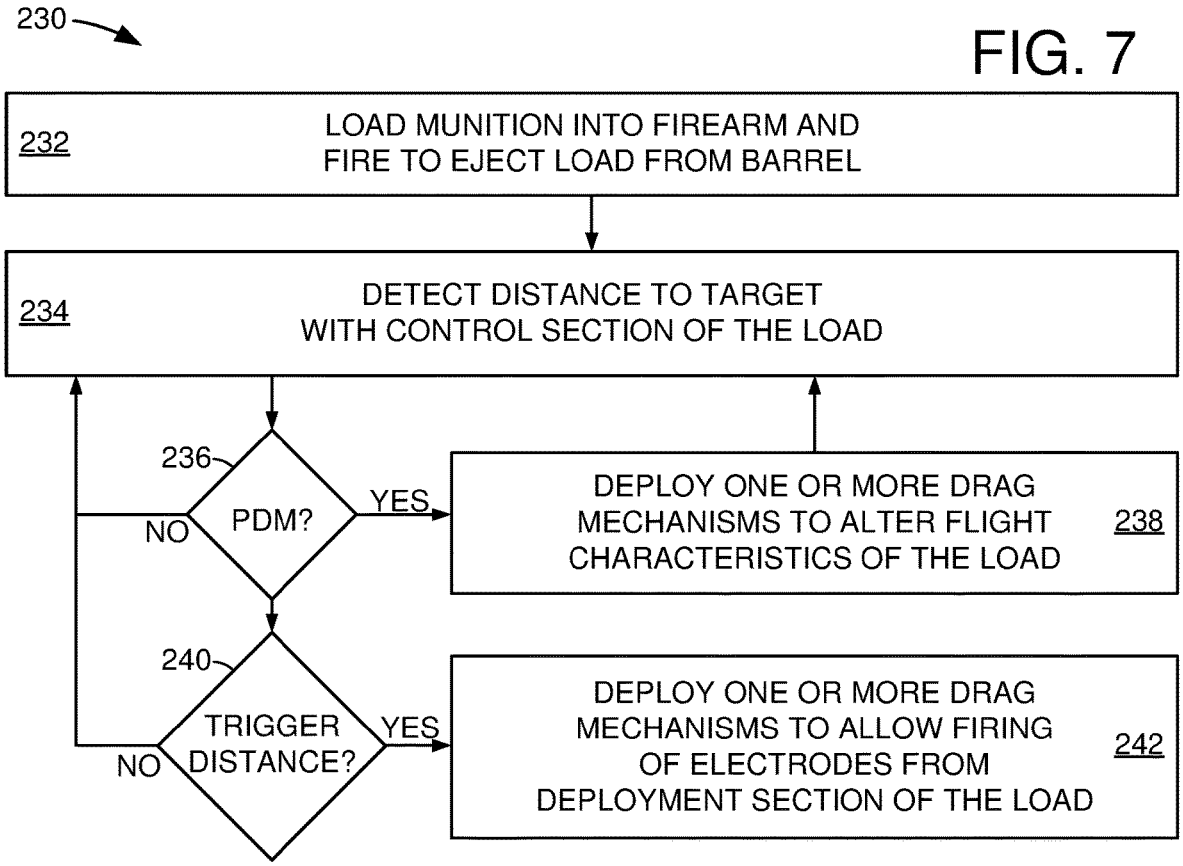
FIG. 7 illustrates an example drag procedure that can be carried out with assorted embodiments of an intelligent munition.

FIG. 7 depicts an example drag procedure 230 that can be carried out with assorted embodiments of the control section 200 as part of an intelligent munition. Initially, an intelligent munition is assembled with a deployment section and control section incorporated into a single load. The munition is loaded into a firearm and selectively fired in step 232 to eject the load from a barrel of the firearm. While in flight, the load detects a distance to a target continuously, sporadically, or randomly with sensors and/or timers in step 234.

It is contemplated that in response to an initial measurement of distance to a target upon exiting the barrel, the control section of the load can evaluate manipulating the flight of the load with a parasitic drag mechanism (PDM) in decision 236. A determination that a drag mechanism can aid the flight of the load to the target accurately with a non-lethal speed in decision 236 prompts step 238 to deploy one or more drag mechanisms from the load. For example, step 238 can increase stability, increase range, or decrease range in response to detection of a distance to a target while the load is 0-10 feet from the barrel of the firearm. As another example, the load can determine that a target is too close to ensure non-lethality and executes step 238 to slow the speed and reduce range of the load without altering the load's pitch, yaw, angle, or vector.

In response to deployment of a drag mechanism in step 238, or if no drag mechanism is deployed from decision 236, step 234 can be conducted to identify the location of a target. It is contemplated that detection of a target in step 234 can involve detecting movement and a destination for electrodes to be shot. Through the evaluation of current, and predicted, load flight characteristics, such as speed, direction, and stability, along with the distance to a target allows a load to cyclically evaluate in decision 236 if drag mechanisms can improve the accuracy and/or non-lethality of the load. Hence, decision 236 can result in any number of redundant, or different drag mechanisms being electronically selected and mechanically propelled from the control section of the load concurrently or sequentially.

While decision 236 is determining if and how to manipulate load flight characteristics, decision 240 compares a current location of the load relative to the target to a predetermined threshold distance. Once the threshold distance is reached, which may be relative to the detected speed of the load, step 242 proceeds to deploy one or more parasitic drag mechanisms, such as a parachute or foil, to bring the load to a speed conducive to firing one or more electrodes towards the target with accuracy and efficiency without being lethal.

Figure 8A:
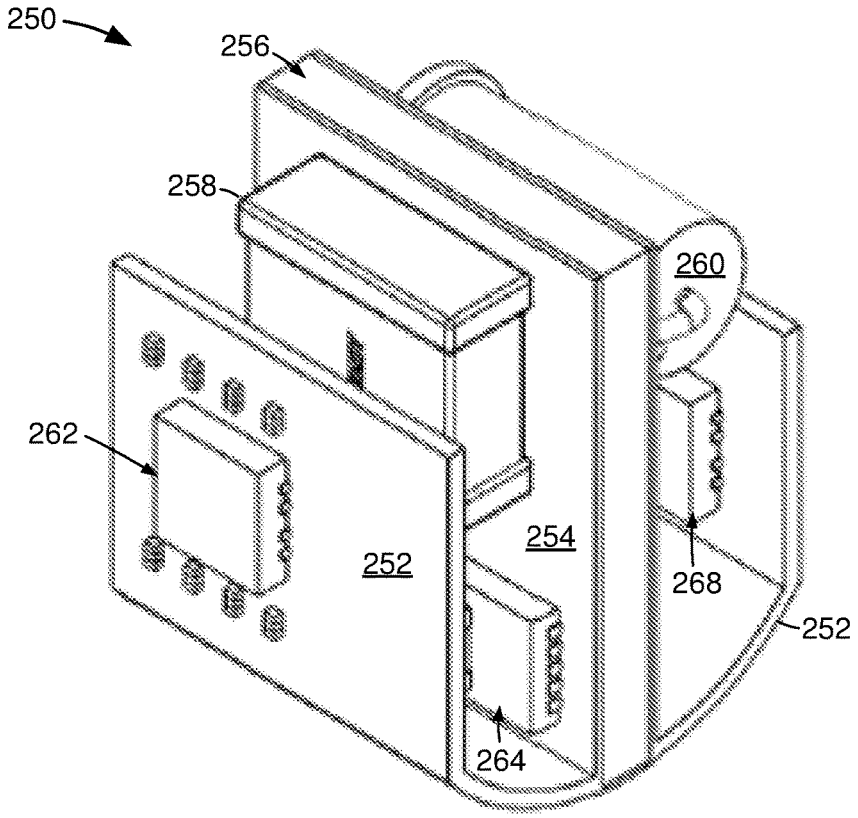
FIGS. 8A & 8B respectively depict portions of an example control package that may be utilized in various embodiments of an intelligent munition.
Figure 8B:
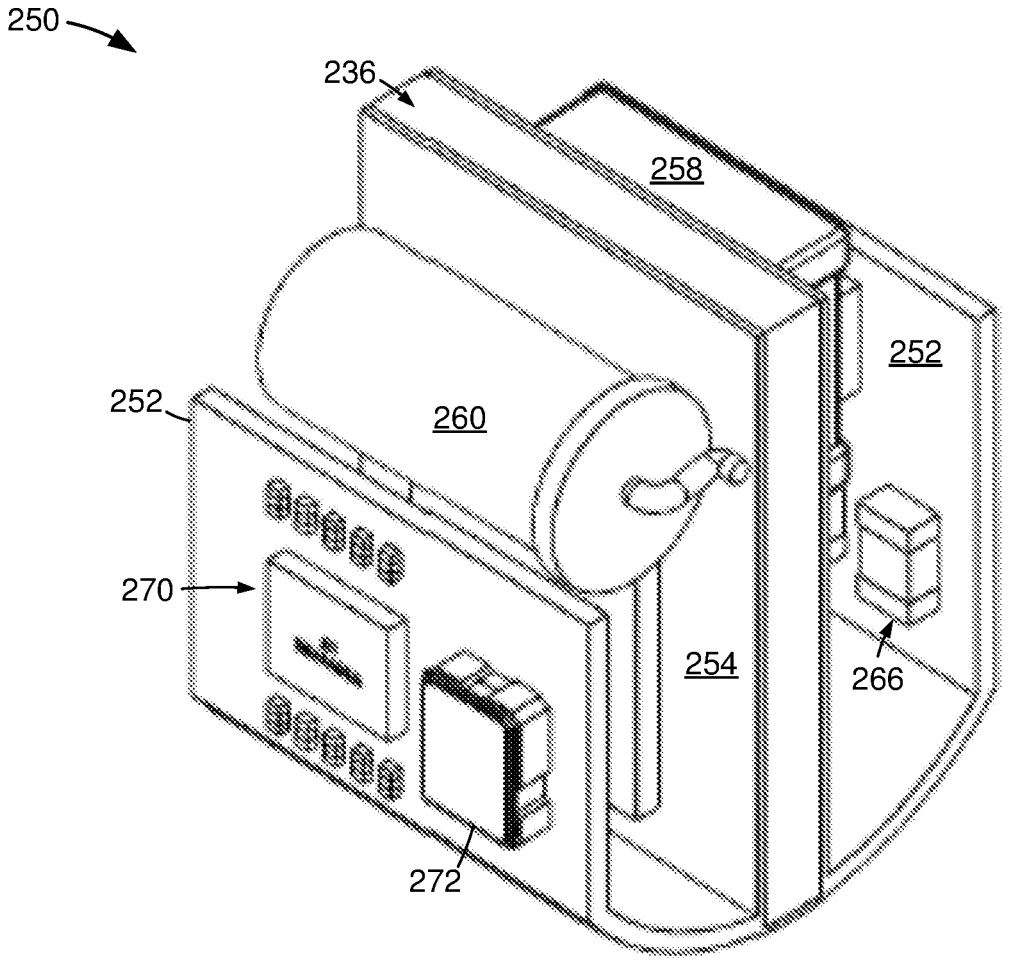

FIGS. 8A & 8B respectively depict portions of an example control package 250 constructed and operated in accordance with various embodiments to provide optimized munition deployment. The view of FIG. 8A conveys how a support structure 252 has a midplane 254 configured with a power source 256, such as a lithium ion capacitor and/or battery. The midplane 254 physically supports a high voltage capacitor 258 and a gravity switch 260. It is contemplated the midplane 254 supports a parachute circuit and/or a communication circuit that are respectively configured to deploy a parachute at a selected distance to a target and communicate the status of the load to a host. A high voltage charge gate 262 can be connected to a power conversion switching regulator 264 and charging components 266, as shown in FIG. 8B.

In some embodiments, the control package 250 has one or more sensors 268, such as an accelerometer, proximity detector, sonar detector, or optical detector. The control package 250 can have one or more communication pathways with the host firearm, host user, and/or target via a communication circuit 270. It is contemplated, but not required, that the communication circuit 270 provides radio frequency, intermittent frequency, cellular, broadband, and/or optical data pathways. The ability to arrange sensors 268 and/or communication circuitry 270 allows the control package 250 to intelligently monitor and react to real-time conditions while traveling from a firearm to a target.

Figure 9:
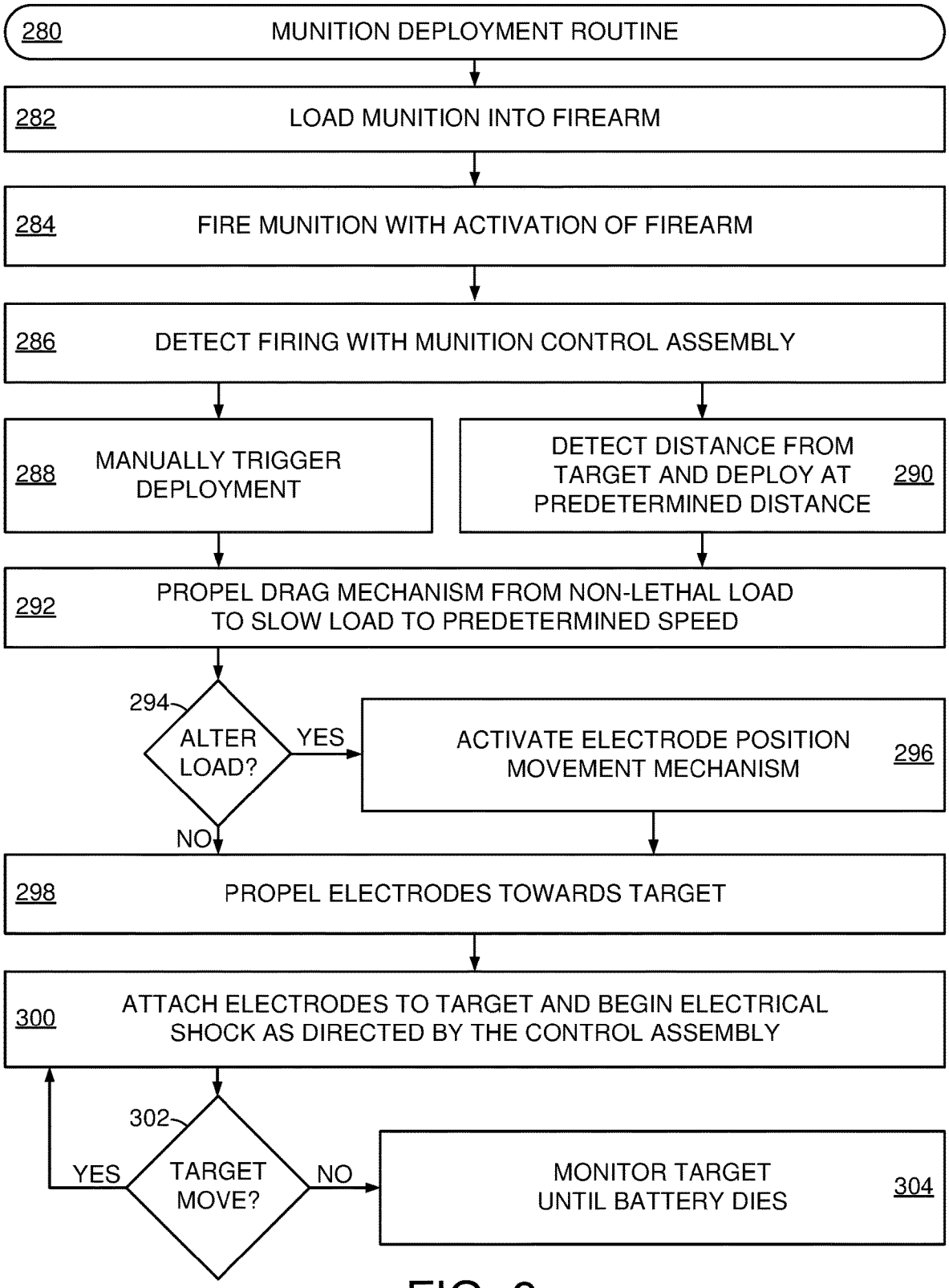
FIG. 9 is a flowchart of an example munition deployment routine that can be executed with the assorted embodiments of FIGS. 1-8B.

FIG. 9 depicts a flowchart of an example munition deployment routine 280 that can be carried out with the assorted embodiments of FIGS. 4A-8B. The routine 280 can begin with an intelligent munition being loaded into a firearm in step 282. It is noted that the firearm can be any type and caliber with a manual or automatic firing mechanism that is activated in step 284 to fire the intelligent munition and propel a non-lethal load portion of the munition down the barrel of the firearm towards a target. Such munition propulsion can derive from an amount of gunpowder ignited by one or more primers.

The propulsion of the non-lethal load down the barrel and towards the target at a muzzle velocity can be detected by one or more sensors of the control assembly of the load. The detection of the muzzle velocity of the load can be complemented by detection of other characteristics by the control assembly, such as spin rate, wind velocity, wind direction, and distance to target. The ability to utilize one or more sensors to concurrently, sequentially, and redundantly detect current conditions of the non-lethal load in-flight to the target allows the load to intelligently react to optimize accuracy, electrode deployment, and non-lethality. The detection of load conditions allows the load to quickly and precisely compute the distance to a target in real-time. For instance, a radio frequency can be used concurrently and/or redundantly with an optical, acoustic, or mechanical detector to verify how far the load is from the target and how fast the load is traveling.

It is contemplated that the load can be utilized manually in step 288 with a user triggering deployment of an electrode sequence. Such manual triggering can be done via wireless activation via cellular, radio frequency, intermediate frequency, sonar, laser, or other wireless communication protocol controlled by the user. Alternatively, step 290 can autonomously detect at least distance to the target and deploy an electrode sequence in response to the detected distance to target, which may involve one or more detected conditions, such as load velocity. Various embodiments can utilize a combination of steps 288 and 290 by having a user supplement autonomous control, such as with a laser painting a target.

The computation of the distance to the target and velocity of the load allows the control assembly to determine when to deploy one or more parasitic drag mechanisms in step 292 as part of an electrode sequence to slow the load to a predetermined electrode deployment speed, such as 80 m/s. That is, the control assembly of a load can intelligently deploy at least one parasitic drag mechanisms based on multiple detected conditions instead of relying on a simple timer or single sensed parameter. The deployment of a drag mechanism in step 292 can involve combusting a propellant and/or releasing potential mechanical energy, such as via a spring, explosion, or vent.

The releasing of a drag mechanism and slowing of the load to a predetermined speed allows for time to alter the position and/or orientation of the electrode deployment section of the load relative to a target, which can accommodate for a moving target and/or changing environmental conditions. Decision 294 evaluates if, after drag mechanism deployment, additional mechanisms are to be activated to change the pitch, yaw, and orientation of the electrode deployment section of the load, which can be detected and verified by the control assembly of the load. If so, step 296 activates one or more electrode position movement mechanisms, such as a solenoid, pneumatic jet, latch, valve, piezoelectric actuator, or piston, to change where the electrodes are pointing.

At the conclusion of the alteration of the position of the electrode deployment section in step 296, or in the event no repositioning is called for from decision 294, step 298 proceeds to activate one or more electrodes to be shot from the deployment section towards the target. The shooting of the electrodes can be done with one or more propellants and can involve the tethering of at least one electrically conductive wire that is electrically connected to, and controlled by, the control assembly. It is noted that the electrodes are shot towards the target in step 298 while the load is in-flight, in motion towards the target, and off the ground.

The propelled electrodes then strike the target with non-lethal force, but sufficient force to physically connect each electrode to the skin or superficial tissue of the target in step 300 with the aid of the shape, weight, and material of the respective electrodes. The physical and electrical connection of the electrodes to the target is detected by the control system and triggers the control assembly to activate the discharge of electrical current to the target. The electrical current can be intelligently chosen by the control assembly to disable the target in response to the number of electrodes concurrently activated. It is noted that the control assembly can intelligently choose the type of electrical current discharge as part of step 300, such as by constant or pulsed discharge.

While step 300 can operate for any amount of time, some embodiments intelligently utilize less than all of the power reserve of the control assembly. As such, the target can be disabled and the control assembly can continue to have power to monitor target activity even after the control assembly comes to rest on the ground. Decision 302 evaluates if the target has subsequently moved after being disabled. The detection of target movement prompts step 300 to be revisited and another electrical discharge to be released with the expectation that further debilitation will be experienced by the target. In the event no target movement is detected, step 304 continues to monitor at least the target until the power reserve of the control assembly is depleted.

During step 304, it is contemplated that other conditions can be monitored, logged, and or communicated to a remote host. For instance, one or more detectors of the control assembly can be used to detect the number, movement, and speed of various people and/or equipment present near the target. As another non-limiting example, step 304 can log the efficiency of the electrode deployment and target disabling so that alterations to future munition deployments can be undertaken proactively, such as parachute deployment speed or amount of propellant used for the respective electrodes.

What is claimed is:

1. A method comprising:

packaging a load comprising a control section and an electrode deployment section in a munition case having a small arms form factor, the control section comprising a control assembly, a sensor, a propellant package, a first drag mechanism and a second drag mechanism;

firing the munition case with a firearm to propel the load from the munition case from a barrel of the firearm towards a target;

using the sensor to determine a relative position of the load with respect to the target;

selecting the first drag mechanism using the control assembly in response to the determined relative position of the load with respect to the target; and activating the first drag mechanism by igniting the propellant package responsive to an activation signal from the control assembly while the load is in flight to alter a flight characteristic of the load.

2. The method of claim 1, wherein the first drag mechanism comprises a parachute that is propelled from a rearward portion of the load in flight responsive to electronic or mechanical activation of the propellant package by the activation signal from the control assembly.

3. The method of claim 1, wherein the propellant package is electronically activated by the control assembly of the control system to deploy the first drag mechanism responsive to a comparison of the determined relative position of the load to a predetermined threshold distance to the target.

4. The method of claim 1, wherein the propellant package comprises gunpowder that is ignited to deploy the first drag mechanism.

5. The method of claim 1, wherein the first drag mechanism is deployed responsive to the load reaching a predetermined distance from the target.

6. The method of claim 1, wherein the first drag mechanism comprises a streamer that trails the load.

7. The method of claim 1, wherein the second drag mechanism is activated by the control assembly when the load is at a second distance from the target after the first drag mechanism is activated by the control assembly when the load is at a first distance from the target, the first distance greater than the second distance, both the first and second distances determined by the sensor.

8. The method of claim 1, wherein the first drag mechanism and second drag mechanism are concurrently activated by the control assembly.

9. The method of claim 1, wherein the control section further comprises a compressed garter spring adjacent the propellant package to facilitate deployment of the first drag mechanism.

10. The method of claim 1, wherein the sensor comprises at least a selected one of an accelerometer, a proximity detector, an optical detector, a sonar detector, an inertial switch or an antenna.

11. The method of claim 1, further comprising firing at least one electrode from the electrode deployment section towards the target while the first drag mechanism is active.

12. The method of claim 1, wherein the determined relative distance is a detected distance to the target calculated by the control assembly from an output value from the sensor.

13. The method of claim 1, wherein the sensor further detects at least a selected one of a spin rate, a wind velocity, a wind direction or an orientation associated with the load.

14. The method of claim 1, further comprising transmitting to the load, from an external user source, an external activation signal while the load is in flight, the control assembly deploying at least one electrode towards the target to immobilize the target via electrical charge responsive to the external activation signal.

15. The method of claim 1, wherein the control assembly comprises electronic circuitry and a power source.

16. A method for immobilizing a human target, comprising:

firing an intelligent munition in a direction towards the human target using a firearm, the intelligent munition having a small arms form factor and comprising a control section and an electrode deployment section, the control section comprising a control assembly, a sensor, a propellant package, a first drag mechanism and a different, second drag mechanism, the electrode deployment section comprising at least one electrode;

using the sensor to determine a relative position of the load with respect to the target; and deploying, responsive to an activation signal from the control assembly based on the relative position of the load, the first drag mechanism while the load is in flight to alter a flight characteristic of the load, the first drag mechanism comprising a parachute.

17. The method of claim 16, further comprising a step of using a propellant package and a compressed garter spring of the control section to deploy the parachute.

18. The method of claim 16, wherein the control assembly comprises an electronic circuit and a power supply comprising at least one of a battery or a capacitor.

19. The method of claim 16, wherein the control assembly is configured to select deployment of the first drag mechanism responsive to the relative position of the load being a first distance from the human target and to select deployment of the second drag mechanism responsive to the relative position of the load being a second distance from the human target.

20. The method of claim 16, further comprising a step of firing the at least one electrode from the electrode deployment section responsive to a second relative position detected by the sensor.

* * * * *